US005555716A

United States Patent [19]

Dugan

[11] Patent Number: 5,555,716

[45] Date of Patent: Sep. 17, 1996

[54] YARN HAVING MICROFIBER SHEATH SURROUNDING NON-MICROFIBER CORE

[75] Inventor: Jeffrey S. Dugan, Asheville, N.C.

[73] Assignee: BASF Corporation, Mount Olive, N.J.

[21] Appl. No.: 334,028

[22] Filed: Nov. 2, 1994

[51] Int. Cl.[6] ..... D02G 3/02; D02G 3/06

[52] U.S. Cl. ..... 57/224; 57/210

[58] Field of Search ..... 57/3, 6, 210, 224, 57/232, 233

[56] References Cited

U.S. PATENT DOCUMENTS

| | | | |
|---|---|---|---|
| 2,044,130 | 6/1936 | Sowter | 57/210 |
| 3,382,305 | 5/1968 | Breen | 264/171 |
| 3,700,545 | 10/1972 | Matsui et al. | 161/175 |
| 3,734,874 | 5/1973 | Kibler et al. | 260/29.2 E |
| 3,779,993 | 12/1973 | Kibler et al. | 260/75 S |
| 3,789,461 | 2/1974 | Nakano et al. | 19/0.35 |
| 3,828,544 | 8/1974 | Alker | 57/152 |
| 4,225,442 | 9/1980 | Tremblay et al. | 210/497.1 |
| 4,233,355 | 11/1980 | Sato et al. | 428/224 |
| 4,304,901 | 12/1981 | O'Neill et al. | 528/290 |
| 4,365,464 | 12/1982 | Graham, Jr. et al. | 57/12 |
| 4,481,759 | 11/1984 | Venot | 57/5 |
| 4,663,221 | 5/1987 | Makimura et al. | 428/337 |
| 4,711,079 | 12/1987 | Newton et al. | 57/12 |
| 4,896,406 | 1/1990 | Weingarten et al. | 28/166 |
| 4,961,306 | 10/1990 | Sawhney et al. | 57/12 |
| 4,966,808 | 10/1990 | Kawano | 428/224 |
| 4,976,096 | 12/1990 | Sawhney et al. | 57/12 |
| 5,120,598 | 6/1992 | Robeson et al. | 428/288 |
| 5,124,194 | 6/1992 | Kawano | 428/224 |
| 5,162,074 | 11/1992 | Hills | 156/644 |
| 5,290,626 | 5/1994 | Nishio et al. | 428/224 |

FOREIGN PATENT DOCUMENTS

| | | | |
|---|---|---|---|
| 923010623 | 7/1992 | European Pat. Off. | D01F 8/06 |

*Primary Examiner*—William Stryjewski
*Attorney, Agent, or Firm*—Depaoli & Frenkel, P.C.

[57] ABSTRACT

Disclosed are microfiber-containing core-spun yarns and fabrics formed therefrom, wherein the core-spun yarn contains a core containing one or more non-micro fibers and a sheath covering and twisted about the core, wherein the sheath contains either staple composite islands-in-the-sea microfiber-generating fibers or staple microfibers formed by treating the composite fibers with a solvent to remove the sea component either before or after formation of the fabric.

31 Claims, 1 Drawing Sheet

YARN HAVING MICROFIBER SHEATH SURROUNDING NON-MICROFIBER CORE

BACKGROUND OF THE INVENTION

This invention relates to novel microfiber-containing yarns and fabrics formed therefrom. More particularly, this invention relates to novel core-spun yarns and fabrics made from such yarns wherein the core-spun yarns contain a microfiber element.

Microfibers are very thin fibers having a linear density of less than 1 denier per filament (dpf), making these fibers even finer than silk, which has a linear density of 1 dpf. Microfibers, also known as "microdenier fibers", have silk-like properties, including the drape, flow, look, feel, movement, softness and luxuriousness of silk, which make the microfibers desirable in the fashion industry for making items such as intimate apparel, outerwear, and sportswear. Although similar to silk, synthetic microfibers also have the useful properties and performance imparted to and in common with certain man-made fibers. For example, synthetic microfibers tend to be easy to care for and often have "wash & wear" capability.

Microfibers are typically formed from composite fibers by processes well known in the art. Composite fibers are manufactured in general by combining at least two fiber-forming polymers via extrusion. Microfibers can be formed from such composite fibers by dissolving one of the polymer components from the composite fibers.

U.S. Pat. No. 3,700,545 discloses a multi-segmented (i.e., multilayered) polyester or polyamide fiber having at least 10 fine segments (layers) with cross sectional shapes and areas irregular and uneven to each other. The spun fibers are treated with an alkali or an acid to decompose and remove at least a part of the polyester or polyamide. Also described therein is a complex spinneret for the manufacture of such fibers.

U.S. Pat. No. 3,382,305 discloses a process for the formation of microfibers having an average diameter of 0.01 to 3 microns by blending two incompatible polymers and extruding the resultant mixture into filaments and further dissolving one of the polymers from the filament.

U.S. Pat. No. 5,120,598 describes ultra-fine polymeric fibers for cleaning up oil spills. The fibers were produced by mixing a polyolefin with poly(vinyl alcohol) and extruding the mixture through a die followed by further orientation. The poly(vinyl alcohol) is extracted with water to yield ultra-fine polymeric fibers.

EP-A-0,498,672 discloses microfiber-generating fibers of island-in-the-sea type obtained by melt extrusion of a mixture of two polymers, whereby the sea polymer is soluble in a solvent and releases the insoluble island fiber of a fineness of 0.01 denier or less. Described is poly(vinyl) alcohol as the sea polymer.

U.S. Pat. No. 4,233,355 discloses a separable unitary composite fiber comprised of a polyester or polyamide which is insoluble in a given solvent and a copolyester of ethylene terephthalate units and ethylene 5-sodium sulfoisophthalate units, which is soluble in a given solvent. The composite fiber was treated with an aqueous alkaline solution to dissolve out at least part of the soluble polymer component to yield fine fibers. The cross sectional views of the composite fibers show an "islands-in-the-sea" type, where the "islands" are the fine fibers of the insoluble polymer surrounded by the "sea" of the soluble polymer. The highest described number of segments or "islands" are 14 and the lowest described fineness were 108 filaments having a total fineness of 70 denier which corresponds to 0.65 denier per filament.

A particularly useful process of forming microfibers is disclosed in copending, commonly assigned U.S. Patent application Ser. No. 08/040,715 (filed Mar. 31, 1993), now U.S. Pat. No. 5,366,804 which will be more fully described hereinbelow and which solves underlying problems associated with previous known processes of forming microfibers.

Fabrics which are composed of microfiber yarns, whether formed completely from microfiber yarns or from a blend of 100% microfiber yarns and additional yarns, are expensive, primarily because the processes for making the microfibers and yarns are highly specialized and generate a relatively large amount of waste. In addition, fabrics made entirely of microfiber yarn will have limited use in applications requiring properties beyond those provided by the microfiber yarn. For example, processing conditions used in making microfibers can result in microfibers having low shrinkage. Fabrics made entirely of such low shrinkage microfibers cannot be used in applications requiring fabrics having high shrinkage as well as silk-like and wash-and-wear properties. Fabrics made entirely of low shrinkage microfibers are also generally unsuitable for use in sportswear or heavyweight apparel, e.g., pants and uniforms, which should feel soft like cotton but have greater strength than is generally provided by a microfiber yarn.

In making fabrics having two conflicting properties, e.g., softness and high strength, it is desirable to have sheath/core configuration yarns so that the fabric has the feel imparted by one fiber but the strength imparted by another. Core-spun yarns having a distinct sheath/core structure with different fibers in the core and in the sheath and possessing most of the advantageous properties of both the core and sheath fibers are known in the art. Reference is made, for example, to U.S. Pat. Nos. 3,828,544 to Alker and 4,711,079 to Newton et al.

Prior to the present invention, however, it has not been suggested to use microfibers or microfiber-generating fibers in either the sheath or the core of core-spun yarns nor how to incorporate the highly specialized microfiber-manufacturing process into a core-spinning process to form a core-spun yarn and fabric therefrom without sacrificing the excellent properties imparted by the microfibers.

Accordingly, it is a primary object of this invention to provide a microfiber-containing yarn which has advantageous properties in addition to those properties generally associated with 100% microfiber yarns.

It is another object of this invention to provide a less expensive microfiber-containing yarn without substantially sacrificing the excellent properties associated with 100% microfiber yarns.

It is a further object to provide a fabric made from a microfiber-containing yarn having the characteristics set forth in the foregoing objects.

These and other objects which are achieved according to the present invention can be discerned from the foregoing description.

SUMMARY OF THE INVENTION

The present invention provides a microfiber-containing yarn and fabric which have the properties typically associated with microfiber yarns and fabrics while also having other properties beyond those found in conventional microfiber yarns and fabrics. In addition, the microfiber-containing yarn and fabric of this invention are less expensive than 100% microfiber yarns and fabrics but have the same silk-like properties possessed by the more expensive yarns and fabrics.

The present invention is based on the discovery that a less expensive microfiber-containing yarn having the same silk-like properties possessed by more expensive microfiber-containing yarns as well as having properties beyond those usually associated with 100% microfiber yarns can be obtained from a core-spun yarn containing a sheath of staple microfibers around a relatively inexpensive non-microfiber core.

Accordingly, one aspect of this invention is directed to a microfiber-containing core spun yarn comprising:

(A) a core comprising one or more non-micro fibers; and (B) a sheath covering and twisted about said core, wherein said sheath comprises staple microfibers.

Another aspect of the present invention is directed to a microfiber-containing core-spun yarn comprising:

(A) a core comprising one or more non-micro fibers; and (B) a sheath covering and twisted about said core, wherein said sheath comprises staple microfiber-generating composite fibers, wherein each of said composite fibers has an islands-in-the-sea structure and comprises a sea component and an islands component, wherein said sea component is soluble in a solvent and said islands component is insoluble in said solvent.

The microfibers are formed by treating the composite microfiber-generating fibers with a solvent in which the sea component is soluble and the islands component is insoluble. The composite fibers can be treated by the solvent to remove the sea component either before or after formation of the fabric.

The present invention is also directed to fabrics made from such core-spun yarns, and to methods of forming such fabrics.

Fabrics made from the core-spun yarns of this invention have much the same luster and handle as fabrics made from 100% microfiber yarns but are less expensive. In addition, proper selection of the core fiber allows some of the properties of the core-spun yarn to be adjusted beyond those of the microfiber sheath, for example, drapeability, increased colorfastness, wash & wear capability, and ease in caring for the yarn as well as improved processing. For example, if manufacturing processes require yarns or fabrics to possess great strength or high shrinkage, a high-strength or high-shrinkage fiber can be used in the core of the core-spun yarn to give the yarn strength or shrinkage that could not be possessed by a 100% microfiber yarn.

DETAILED DESCRIPTION OF THE INVENTION

Figure 1:
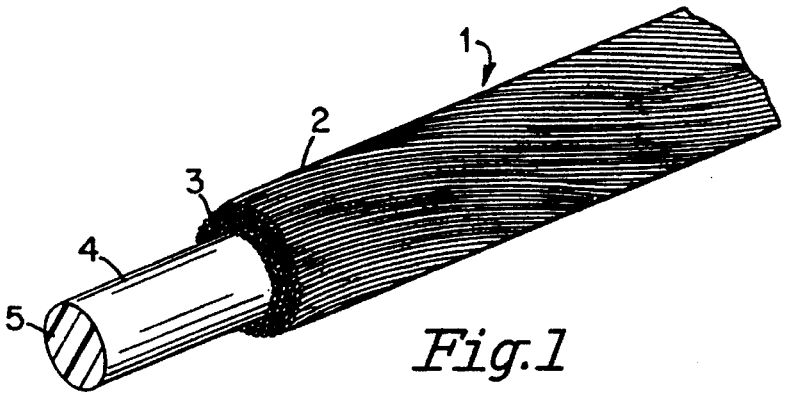
FIG. 1 is a perspective cut-away view of a core-spun yarn according to the present invention having a core of continuous filaments and a sheath covering the core, wherein the sheath contains staple composite microfiber-generating fibers.

Core-spinning generally involves spinning a fiber bundle around a continuous or spun yarn central core. The core-spun yarn of this invention has a sheath/core structure containing a non-microfiber core and a sheath surrounding and being twisted around the core, wherein the sheath contains staple composite microfiber-generating fibers or staple microfibers. The staple composite microfiber-generating fibers used to generate the microfibers each have an "islands-in-the-sea" structure, wherein the sea component is soluble in a given solvent and the islands component is insoluble in the solvent. The core-spun yarn may then be treated by the solvent to remove the sea component and leave behind the islands component as microfibers, and subsequently undergo fabric processing to form a fabric. Alternatively, the core-spun yarn may be formed into a fabric and the resulting fabric treated with a solvent to remove the sea component to form microfibers. The final fabric of this invention contains core-spun yarn having a staple microfiber sheath twisted around a non-microfiber core. Such fabric may be a woven or non-woven knit fabric.

The staple composite microfiber-generating fibers (composite fibers) which may form the sheath of the core-spun yarn of this invention can be formed by any conventional process for spinning a bicomponent fiber. Non-limiting examples of suitable composite fiber-forming methods are disclosed, for example, in U.S. Pat. Nos. 5,290,626; 4,966,808; and 5,124,194; all of the foregoing patents being incorporated by reference herein in their entirety.

Composite fibers are generally prepared by melting two fiber-forming polymers in two separate extruders and then directing the two polymer flows into one spinneret having a plurality of distribution flow paths. The distribution flow paths can be in the form of small thin tubes which are made, for example, by drilling. Such flow paths are described, e.g. in U.S. Pat. No. 3,700,545, which is hereby incorporated by reference herein. Preferably, the distribution flow paths are etched plates as described in U.S. Pat. No. 5,162,074 and in copending, commonly assigned U.S. Patent application Ser. No. 08/040,715 (filed Mar. 31, 1993), both of which are hereby incorporated by reference herein in their entirety. In these latter two references, a distributor plate or a plurality of adjacently disposed distributor plates in a spin pack takes the form of a thin metal sheet in which distribution flow paths are etched to provide precisely formed and densely packed passage configurations. The distribution flow paths may be etched shallow distribution channels arranged to conduct polymer flow along the distributor plate surface in a direction transverse to the net flow through the spin pack; and distribution apertures etched through the distributor plate. The etching process, which may be photochemical etching, is much less expensive than the drilling, milling, reaming, or other machining/cutting processes used to form distribution paths in the thick plates used in the prior art. Moreover, the thin distribution plates with thicknesses of, for example, less than 0.10 inch, and typically no thicker than 0.030 inch, are themselves much less expensive than the thicker distributor plates conventionally used in the prior art.

Etching permits the distribution apertures to be precisely defined with very small length (L) to diameter (D) ratios of 1.5 or less, and more typically, 0.7 or less. The individual plural polymer components can be directed to the etched distributor plates via respective groups of slots in a non-disposable primary plate. Transverse pressure variations may be mitigated by interposing a permanent metering plate between the primary plate and the etched distribution plates. Each group of slots in the primary non-disposable plate carries a respective polymer component and includes at least two slots. The slots of each group can be positioned so that adjacent slots will either contain the same polymer component or different polymer components. Typically, the slots are positionally alternated or interlaced with slots of the other groups so that no two adjacent slots carry the same polymer component.

The transverse distribution of polymer in the spin pack, as required for plural-component fiber extrusion, is enhanced and simplified by the shallow channels made feasible by the etching process. Typically, the depth of the channels is less than 0.016 inch and, in most cases, less than 0.010 inch. The polymer can thus be efficiently distributed, transversely of the net flow direction in the spin pack, without taking up considerable flow path length, thereby permitting the overall thickness, for example, in the flow directing of the spin pack to be kept small. Etching also permits the distribution flow channels and apertures to be tightly packed, resulting in a spin pack of high productivity (i.e., grams of polymer per square centimeter of spinneret face area). The etching process, in particular, photochemical etching, is relatively inexpensive, as is the thin metal distributor plate itself. The resulting low cost etched plate can, therefore, be discarded and economically replaced at the times of periodic cleaning of the spin pack. The replacement distributor plate can be identical to the discarded plate, or the plate can have different distribution flow path configurations if different polymer configurations are to be extruded. The precision afforded by etching assures that the resulting fibers are uniform in cross-section and denier.

It is of high economic interest to achieve fiber smallness by increasing the number of islands and to reduce the expense of consuming and disposing of the residual "sea" polymer by minimizing the content of the sea polymer in the composite fibers. With etched thin plates, composite fibers can be manufactured which have a cross-section having more than 60 segments of water-insoluble polymer surrounded by the water-dissipatable polymer.

The composite microfiber-generating fibers can be prepared in accordance with the process disclosed in U.S. Pat. application Ser. No. 08/040,715 (filed Mar. 31, 1993), hereinabove cited and discussed immediately above and incorporated by reference herein. In that process, a water-insoluble polymer and a water-dissipatable polymer are melted in two separate extruders and provided as two separate melt flows whereby the water-insoluble polymer flow and the water-dissipatable polymer flow are directed into the respective channels of the etched thin plates as above-described. The composite fibers exit the spinneret assembly and are spun with a speed of from about 100 to about 10,000 m/min, preferably with about 800 to about 2000 m/min.

The extruded composite fibers are quenched with a cross flow of air and are thereby solidified. During an optional subsequent treatment of the fibers with a spin finish, it is important to avoid a premature dissolution of the water-dissipatable polymer in the water of the spin finish. The finish can be prepared from 100% oil (or "neat") such as butyl stearate, trimethylolpropane triester of caprylic acid, tridecyl stearate, mineral oil and the like, and applied at a much slower rate than is used for an aqueous solution and/or emulsion of from about 3% to about 25%, preferably from about 5% to about 10% by weight. This water-free oil can be applied at about 0.1% to about 5% by weight, preferably 0.5% to 1.5% by weight based on the weight of the fiber, and coats the surface of the composite filaments. This coating reduces destructive absorption of atmospheric moisture by the water-dissipatable polymer. The coating also reduces fusing of the polymer between adjacent composite filaments if the polymer softens during subsequent processing such as an additional drawing step and the like. Other additives may be incorporated in the spin finish in effective amounts like emulsifiers, antistatics, antifoams, thermostabilizers, UV stabilizers, and the like.

The fibers or filaments are then drawn and cut into staple fibers. Preferably, the staple fibers have a length of from about 1 mm to about 200 mm and more preferably from about 5 mm to about 55 mm.

Each composite staple fiber has an "islands-in-the-sea" structure. In the core-spun yarn of this invention or the final fabric made therefrom, the microfibers are obtained by removing the sea component of the composite fibers by treating the composite fibers with a solvent in which the sea component is soluble and the islands component is insoluble.

The sea component of the islands-in-the-sea structure of the composite fibers is soluble in a solvent which is used to remove the sea component from the composite fibers to generate the microfibers. Preferably, the sea component comprises a thermoplastic polymer capable of being removed by a solvent such as water. Water-dissipatable polymers suitable for use in the sea component are disclosed, for example, in U.S. Pat. Nos. 3,734,874; 3,779,993; and 4,304,901; the disclosures of which are incorporated by reference herein in their entirety. Examples of suitable polymers for forming the sea component include but are not limited to water-soluble poly(vinyl) alcohol, polystyrene, styrene-acrylonitrile copolymer, and a polyester comprising (i) at least one difunctional dicarboxylic acid, (ii) from about 4 to about 25 mole percent, based on a total of all acid, hydroxyl and amino equivalents being equal to 200 mole percent, of at least one difunctional sulfomonomer containing at least one metal sulfonate group attached to an aromatic nucleus wherein the functional groups are hydroxyl, carboxyl or amino, and, (iii) at least one difunctional reactant like glycol or a mixture of glycol and diamine, at least 15 mol % of the glycol is poly(ethylene glycol) of the formula $$H(OC_2H_4)_n\ OH$$

with n being an integer of between 2 and about 20.

Preferred dicarboxylic acids (i) are terephthalic acid and isophthalic acid, a preferred sulfomonomer (ii) is isophthalic acid containing a sodium sulfonate group, and preferred glycols (iii) are ethylene glycol and diethylene glycol.

A preferred polyester for the sea component comprises at least 80 mole percent isophthalic acid, about 10 mole percent 5-sodium sulfoisophthalic acid and diethylene glycol.

The inherent viscosity of the polyesters, measured in a 60/40 parts by weight solution of phenol/tetrachloroethane at 25° C. and at a concentration of 0.25 gram of polyester in 100 ml solvent, is at least 0.1, preferably at least 0.3.

An example of a suitable polyester is commercially available as AQ-55S from Eastman Chemical Corporation.

Non-limiting examples of suitable solvents to dissolve the sea component include water, toluene, trichloroethylene, perchloroethylene, and the like.

The islands component of the islands-in-the-sea structure is insoluble in the solvent used to dissolve the sea component, and can form independent islands in the sea component. The islands component preferably comprises a thermoplastic polymer. Suitable polymers for forming the islands component include, for example, polyolefins, polyamides, copolyamides, polyesters, and copolyesters.

Polyamides and copolyamides are well known by the general term "nylon" and are long-chain synthetic polymers containing amide (—CO—NH—) linkages along the main polymer chain. Suitable fiber-forming or melt-spinnable polyamides of interest for this invention include those which are obtained by the polymerization of a lactam or an amino acid, or those polymers formed by the condensation of a diamine and a dicarboxylic acid. Typical polyamides include nylon 6, nylon 6/6, nylon 6/10, nylon 6/12, nylon 6T, nylon 11, nylon 12, and copolymers thereof or mixtures thereof. Polyamides can also be copolymers of nylon 6 or nylon 6/6 and a nylon salt obtained by reacting a dicarboxylic acid component such as terephthalic acid, adipic acid, or sebacic acid with a diamine such as hexamethylene diamine, metaxylene diamine, or 1,4-bisaminomethyl cyclohexane. Preferred are poly-epsilon-caprolactam (nylon 6) and polyhexamethylene adipamide (nylon 6/6). Most preferred is nylon 6.

Suitable polyesters and copolyesters include, for example, those prepared by the condensation of aromatic dicarboxylic acids such as terephthalic acid, isophthalic acid, phthalic acid, and naphthalene-2,6-dicarboxylic acid, aliphatic dicarboxylic acids such as adipic acid and sebacic acid or their esters with diol compounds such as ethylene glycol diethylene glycol, 1,4-butanediol, neopentyl glycol and cyclohexane-1,4-dimethanol. Preferred polyesters include polyethylene terephthalate and polybutylene terephthalate. The most preferred polyester for use in this invention is polyethylene terephthalate.

The core component of the core-spun yarns of this invention comprises one or more fibers. The core fibers are not microfibers. These fibers, which will be referred to herein as "non-micro fibers", generally have a linear density of greater than 1 dpf. Thus, the core will contain one or more non-micro fibers.

The non-micro fibers can be prepared by spinning in any known manner including the same manner as the composite fibers are prepared. Preferably, only one polymer is used, although bicomponent fibers, whether side-by-side, sheath-core, etc., can be used to form the core. The non-micro fibers may be composed of naturally-occurring fibers such as jute, cotton, or animal hair such as wool; synthetic polymer fibers such as acrylic, nylon, polyester, polyolefin, aramid, polytetrafluoroethylene fibers, or any thermoplastic polymer used to form the islands component of the composite fibers discussed above; man-made organic fibers derived from natural sources such as rayon or cellulose acetate; inorganic fibers such as metal, glass, graphite; or a blend of two or more of the foregoing fibers. Examples of suitable core thermoplastic polymers include polyolefins, polyamides, copolyamides, polyesters, or copolyesters. Preferred core thermoplastic polymers include, for example, polyethylene, polypropylene, poly-epsilon-caprolactam, polyhexamethylene adipamide, polyethylene terephthalate, and polybutylene terephthalate. Most preferred core thermoplastic polymers include, for example, poly-epsilon-caprolactam, polyhexamethylene adipamide and polyethylene terephthalate.

The non-micro fibers which make up the core of the core-spun yarn of this invention can be in the form of, for example, continuous filament(s), a yarn made from continuous filament(s), or a yarn comprising spun staple fibers.

The non-micro fibers and the staple composite fibers can be core-spun according to methods known in the art. Suitable core spinning methods are disclosed, for example, in U.S. Pat. Nos. 4,711,079; 4,896,406; 4,365,464; 4,481,759; 3,789,461; 4,976,096; and 4,225,442; all of the foregoing patents being hereby incorporated by reference herein in their entirety.

The following definitions apply to several terms used herein:

"sliver" —the product formed by carding or drawing, i.e., a very coarse strand of fibers having essentially no twist.

"carding" —the use of a carding machine to align, clean, and straighten fibers, and to remove very short fibers as well as fine trash, to produce sliver.

"drawing" —the making parallel and straightening of sliver fibers to improve the uniformity of linear density, usually accomplished in 1, 2 or 3 passages through drawing equipment known as a draw frame or drafting frame. In each passage through a draw frame, several sliver strands are combined into a single sliver strand.

"roving" —a strand which is thinner than a sliver and formed by drafting a sliver and imparting a small amount of twist (normally 2 turns per inch) to the strand.

"drafting" —the process whereby a fiber bundle such as a sliver or roving is extended in length in order to reduce the linear density of the bundle and to increase the parallelization of the fibers.

The core-spun yarns of this invention can be made by directly spinning a roving of the staple fibers around the core yarn or filament. Such methods are disclosed, for example, in U.S. Pat. Nos. 4,976,096 and 4,961,306 (both to Sawhney et al.). In a method disclosed in U.S. Pat. No. 4,961,306, a core of continuous filaments or fibrous material is passed from a draft roll nip of a ring spinning apparatus to a wrapping point through a first channel which is essentially straight and perpendicular to the nip. From the draft roll nip, a first wrap strand spaced from the core is passed from the draft roll nip through a curved second channel which merges with the first channel at the wrapping point, where the core and the wrap strand are combined to form core/wrap yarn. The core/wrap yarn may then be passed to a wind-up spindle.

In a method taught in U.S. Pat. No. 4,976,096, a core strand and wrap strands spaced on each side of the core strand are passed from a draft roll nip of a ring spinning apparatus to a stationary support surface that is outwardly, downwardly curved, and which includes an open channel therein which is outwardly, downwardly curved along the surface. First the core strand and then the wrap strands are passed through the open channel of the stationary support surface where the wrap strands converge upon and wrap around the core strand to form wrapped yarn. The wrapped yarn is then passed from the channel to a wind-up assembly.

In making the core-spun yarn of this invention by means of the Sawhney et al. methods described above, an air-jet spinning apparatus may be used instead of a ring-spinning apparatus. Air-jet spinning apparatuses are generally preferred because they allow core-spun yarns to be made directly from slivers rather than from rovings, thereby eliminating the additional step of converting slivers to rovings. Manufacturers of air-jet spinners include, e.g., Murata and Dref.

In another suitable but less preferred core-spinning process, which is disclosed in above-cited U.S. Pat. No. 4,711,079, a sliver of first fibers and a roving of second fibers are fed to a drafting apparatus, which has front and back rolls with an apron therebetween. The two sets of fibers are fed to the drafting apparatus in a manner such that the roving of second fibers will be at the center line of, and on top of, the sliver of first fibers. The roving and sliver are passed together through the rear rolls, apron, and front rolls of the drafting apparatus to produce a drafted composite sliver. Twist is imparted mechanically to the drafted composite sliver to produce a roving having a sheath and core structure. The roving then undergoes additional drafting and mechanical twist is imparted thereto to produce a final core/sheath yarn. The final core-spun yarn of this invention will have a sheath-core structure wherein the sheath contains staple composite microfiber-generating fibers and is twisted around the core which contains non-micro fibers.

By carefully controlling the fiber cohesiveness, one can ensure that the core and the sheath remain entirely distinct. Core cohesiveness can be maintained by: particularly controlling the twist of the roving of core fibers (e.g., so that it has a twist multiple of about 0.25–0.80 turns per inch); and/or applying a finish to the roving of core fibers so that it has higher friction than the composite fibers; and/or passing the sliver and roving through a trumpet so as to precisely control the placement of the roving on top of the sliver so that the roving is at the exact center line of the sliver, and has no opportunity to move off the exact center line before passing to the rear rolls.

The twist of the core-spun yarn is important because it lends integrity to the yarn and to the fabric formed therefrom.

The core-spun yarn of this invention can be converted into fabric by conventional woven or non-woven fabric manufacturing processes. Examples of suitable processes include but are not limited to needlepunching, knitting, stitchbonding, spunlacing, weaving, thermal-bonding and the like.

The sea component of the composite microfiber-generating fibers can be removed either before or after formation of the fabric. As stated previously herein, the sea component is removed by treating the yarn or fabric with the solvent in which the sea-forming polymer is soluble and the islands-forming polymer is insoluble. Treatment of the composite fiber with the solvent is carried out at a temperature and for a period of time sufficient to remove the sea component. For example, if the solvent is water, the fabric can be treated with the water at a temperature of from about 10° C. to about 100° C., preferably from about 50° C. to about 80° C. for a time period of from about 1 to about 180 seconds whereby the water-dissipatable polymer is dissipated or dissolved.

The resulting yarn or fabric will contain a microfiber sheath surrounding a non-micro fiber core. The microfibers preferably have a linear density of less than 0.3 dpf, more preferably less than 0.1 dpf, and most preferably less than 0.01 dpf.

The present invention can be further understood by reference to the drawings.

FIG. 1 shows a core-spun yarn 1 in accordance with the present invention. The core-spun yarn 1 contains a sheath 2 of staple composite microfiber-generating fibers 3 twisted around a core 4 which is composed of a non-microfiber core component 5 containing a continuous monofilament or continuous multicomponent filament.

Figure 2:
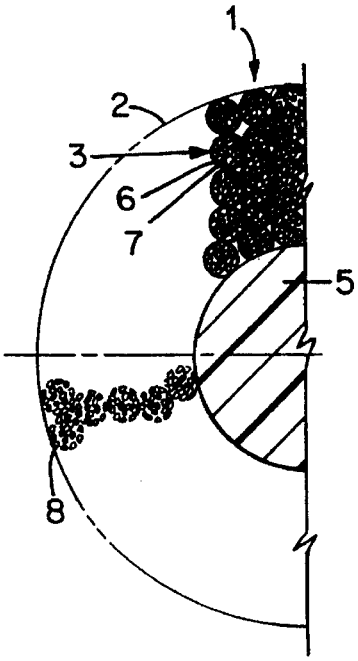
FIG. 2 is a two-part schematic illustration showing (1) a portion of a cross-section of the core-spun yarn shown in FIG. 1 and (2) a cross-sectional view of the core-spun yarn of FIG. 1 after the "sea" or soluble polymer has been removed.

FIG. 2 shows a cross-section of the core-spun yarn 1, wherein the staple composite microfiber-generating fibers 3 in sheath 2 contain a sea component 6 and an islands component 7. After treatment with a solvent to remove the sea component, the staple composite microfiber-generating fibers 3 are converted to microfibers 8.

Figure 3:
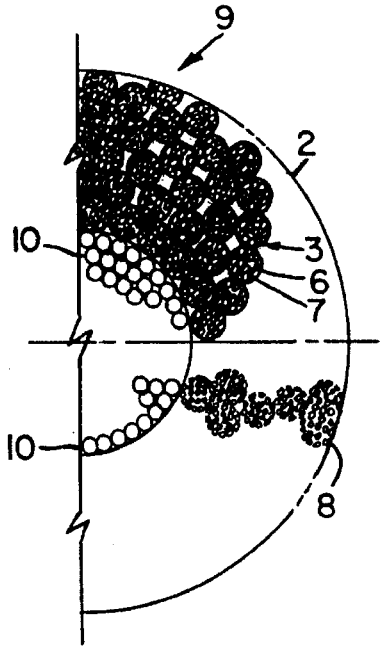
FIG. 3 is a two-part schematic illustration showing (1) a portion of a cross-section of a core-spun yarn according to the present invention having a core of multiple continuous fibers and a sheath covering the core and containing staple composite microfiber-generating fibers having a sea component and an islands component, and (2) a cross-sectional view of the core-spun yarn after the "sea" or soluble polymer has been removed.

FIG. 3 shows a cross section of a core-spun yarn 9 identical to core-spun yarn 1 as shown in FIG. 2 except that core-spun yarn 9 contains a non-microfiber core component 10 containing multiple continuous filaments or multicomponent fibers, rather than a single filament.

As discussed above, the core can be composed of one or more continuous filaments, or the core can be a yarn containing one or more continuous filaments or a spun yarn containing staple fibers.

Both the core and the sheath contribute to the properties of the core-spun yarn and fabric of this invention. The yarn and fabric of this invention will have properties imparted by the microfibers, e.g., silky touch, high luster, etc., and properties imparted by the non-micro fibers, e.g., greater strength, high shrinkage, etc.

In addition, the microfiber-containing yarn and fabric of this invention are economical compared to existing yarns containing 100% microfiber yarn or blends thereof, mainly because of the lower cost of the non-microfiber core. Less expensive fibers are used in the core while premium microfibers in the sheath produce a premium-looking final product.

What is claimed is:

1. A microfiber-containing core-spun yarn comprising:

(A) a core comprising one or more non-micro fibers, and (B) a sheath covering and twisted about said core, wherein said sheath comprises staple microfibers.

2. A core-spun yarn according to claim 1, wherein each of said one or more non-micro fibers in said core is selected from the group consisting of naturally occurring fibers, synthetic polymer fibers, thermoplastic fibers, man-made organic fibers derived from natural sources, inorganic fibers, and a blend of two or more of the foregoing fibers.

3. A core-spun yarn according to claim 2, wherein each of said one or more non-micro fibers in said core is selected from the group consisting of jute, cotton, animal hair, acrylic fibers, nylon fibers, polyester fibers, polyolefin fibers, aramid fibers, polytetrafluoroethylene fibers, rayon fibers, cellulose acetate fibers, metal fibers, glass fibers, and graphite fibers.

4. A core-spun yarn according to claim 2, wherein each of said one or more non-micro fibers in said core comprises a thermoplastic polymer.

5. A core-spun yarn according to claim 4, wherein said thermoplastic polymer is selected from the group consisting of a polyolefin, a polyamide, a copolyamide, a polyester, and a copolyester.

6. A core-spun yarn according to claim 5, wherein said thermoplastic polymer is selected from the group consisting of polyethylene, polypropylene, poly-epsilon-caprolactam, polyhexamethylene adipamide, polyethylene terephthalate, and polybutylene terephthalate.

7. A core-spun yarn according to claim 6, wherein said thermoplastic polymer is selected from the group consisting of poly-epsilon-caprolactam, polyhexamethylene adipamide and polyethylene terephthalate.

8. A core-spun yarn according to claim 1, wherein said core comprises one non-micro fiber.

9. A core-spun yarn according to claim 1, wherein said core comprises a plurality of non-micro fibers.

10. A core-spun yarn according to claim 9, wherein said plurality of non-micro fibers in said core comprises a yarn comprising a plurality of continuous filaments.

11. A core-spun yarn according to claim 9, wherein said plurality of non-micro fibers in said core is a plurality of continuous filaments.

12. A core-spun yarn according to claim 9, wherein said plurality of non-micro fibers is a yarn comprising a plurality of spun staple fibers.

13. A core-spun yarn comprising:

(A) a core component comprising one or more non-micro fibers; and (B) a sheath covering and twisted about said core component, wherein said sheath comprises a plurality of microfiber-generating staple composite fibers, wherein each of said composite fibers has an islands-in-the-sea structure and comprises a sea component and an islands component, wherein said sea component is soluble in a solvent and said islands component is insoluble in said solvent, further wherein each of said staple composite fibers generates a staple microfiber when said sea component is dissolved in said solvent.

14. A core-spun yarn according to claim 13, wherein said sea component comprises a thermoplastic polymer which is soluble in said solvent.

15. A core-spun yarn according to claim 14, wherein said solvent-soluble thermoplastic polymer comprises a polymer selected from the group consisting of water-soluble polyvinyl alcohol, polystyrene, styrene-acrylonitrile copolymer, and a polyester comprising (i) at least one difunctional dicarboxylic acid, (ii) from about 4 to about 25 mole percent, based on a total of all acid, hydroxyl and amino equivalents being equal to 200 mole percent, of at least one difunctional sulfomonomer containing at least one metal sulfonate group attached to an aromatic nucleus wherein the functional groups are hydroxyl, carboxyl, or amino, and, (iii) at least one difunctional reactant like glycol or a mixture of glycol and diamine, at least 15 mol % of the glycol is poly(ethylene glycol) of the formula $$H(OC_2H_4)_nOH$$

with n being an integer of between 2 and about 20.

16. A core-spun yarn according to claim 15, wherein the dicarboxylic acid is selected from the group consisting of terephthalic acid, isophthalic acid and mixtures thereof.

17. A core-spun yarn according to claim 15, wherein the sulfomonomer is a metal sulfoisophthalic acid.

18. A core-spun yarn according to claim 15, wherein the glycol is diethylene glycol.

19. A core-spun yarn according to claim 14, wherein said solvent-soluble thermoplastic polymer is said polyester.

20. A core-spun yarn according to claim 14, wherein the islands component comprises a thermoplastic polymer which is insoluble in said solvent.

21. A core-spun yarn according to claim 20, wherein said solvent-insoluble thermoplastic polymer is selected from the group consisting of a polyolefin, a polyamide, a copolyamide, a polyester and a copolyester.

22. A core-spun yarn according to claim 21, wherein said solvent-insoluble thermoplastic polymer is selected from the group consisting of polyethylene, polypropylene, poly-epsilon-caprolactam, polyhexamethylene adipamide, polyethylene terephthalate, and polybutylene terephthalate.

23. A core-spun yarn according to claim 22, wherein said solvent-insoluble thermoplastic polymer is selected from the group consisting of poly-epsilon-caprolactam, polyhexamethylene adipamide and polyethylene terephthalate.

24. A core-spun yarn according to claim 13, wherein said solvent is selected from the group consisting of water, toluene, trichloroethylene, and perchloroethylene and said solvent is soluble in said sea component and insoluble in said islands component.

25. A fabric comprising core-spun yarn having a sheath and a core, wherein said core comprises one or more non-micro fibers and said sheath surrounds and is twisted about the core and comprises staple microfibers.

26. A fabric according to claim 25, wherein said staple microfibers each have a linear density of less than 0.3 denier per filament.

27. A fabric according to claim 26 wherein said staple microfibers each have a linear density of less than 0.1 denier per filament.

28. A fabric according to claim 27, wherein said staple microfibers have a linear density of less than 0.01 denier per filament.

29. A fabric according to claim 25, wherein said core comprises one non-micro fiber.

30. A fabric according to claim 25, wherein said core comprises a plurality of non-micro fibers.

31. A fabric comprising core-spun yarn containing:

(A) a core component comprising one or more non-micro fibers; and (B) a sheath covering and twisted about said core component, wherein said sheath comprises a plurality of microfiber-generating staple composite fibers, wherein each of said composite fibers has an islands-in-the-sea structure and comprises a sea component and an islands component, wherein said sea component is soluble in a solvent and said islands component is insoluble in said solvent, further wherein each of said staple composite fibers generates a staple microfiber when said sea component is dissolved in said solvent.

* * * * *